United States Patent [19]

Manchak

[11] Patent Number: 4,528,129

[45] Date of Patent: Jul. 9, 1985

[54] PROCESSING RADIOACTIVE WASTES AND URANIUM MILL TAILINGS FOR SAFE ECOLOGICALLY-ACCEPTABLE DISPOSAL

[76] Inventor: Frank Manchak, P.O. Box 30737, Santa Barbara, Calif. 93103

[21] Appl. No.: 374,487

[22] Filed: May 3, 1982

[51] Int. Cl.[3] ..... G21F 9/16

[52] U.S. Cl. ..... 252/628

[58] Field of Search ..... 252/628

[56] References Cited

U.S. PATENT DOCUMENTS 3,274,784 9/1966 Shock et al. ..... 252/628

OTHER PUBLICATIONS

Costello et al., "A Review of the Environmental Impact of Mining and Milling of Uranium Ores" in Northrup et al., EDS *Scientific Basis for Nuclear Waste Management*, vol. 2, Plenum Press, N.Y. (1980), pp. 849–857.

*Primary Examiner*—Deborah L. Kyle

*Attorney, Agent, or Firm*—William C. Babcock

[57] ABSTRACT

Radioactive and associated chemical contaminants present in uranium mill tailings, for example, are isolated from the environment. A matrix product is formed by combining selected clays and lime with the soluble radioactive and chemical contaminants. The clays absorb the majority of all the contaminants. The lime neutralizes the contaminants and cements the clay silicates and absorbed contaminants. The resulting product is of a matrix-like nature and is reverted into a limestone by the uptake of carbon dioxide in a recarbonization process. The radionuclides and chemical contaminants in the resulting product are converted into insoluble oxides or hydroxides which do not appreciably leach out into the ground water. The release of radon gasses is substantially inhibited in the final product, and the release of radon gasses is virtually nonexistent in the final limestone.

4 Claims, 1 Drawing Figure

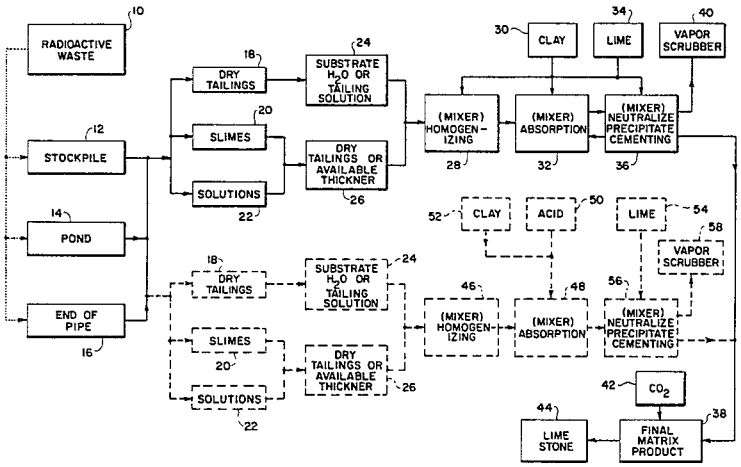

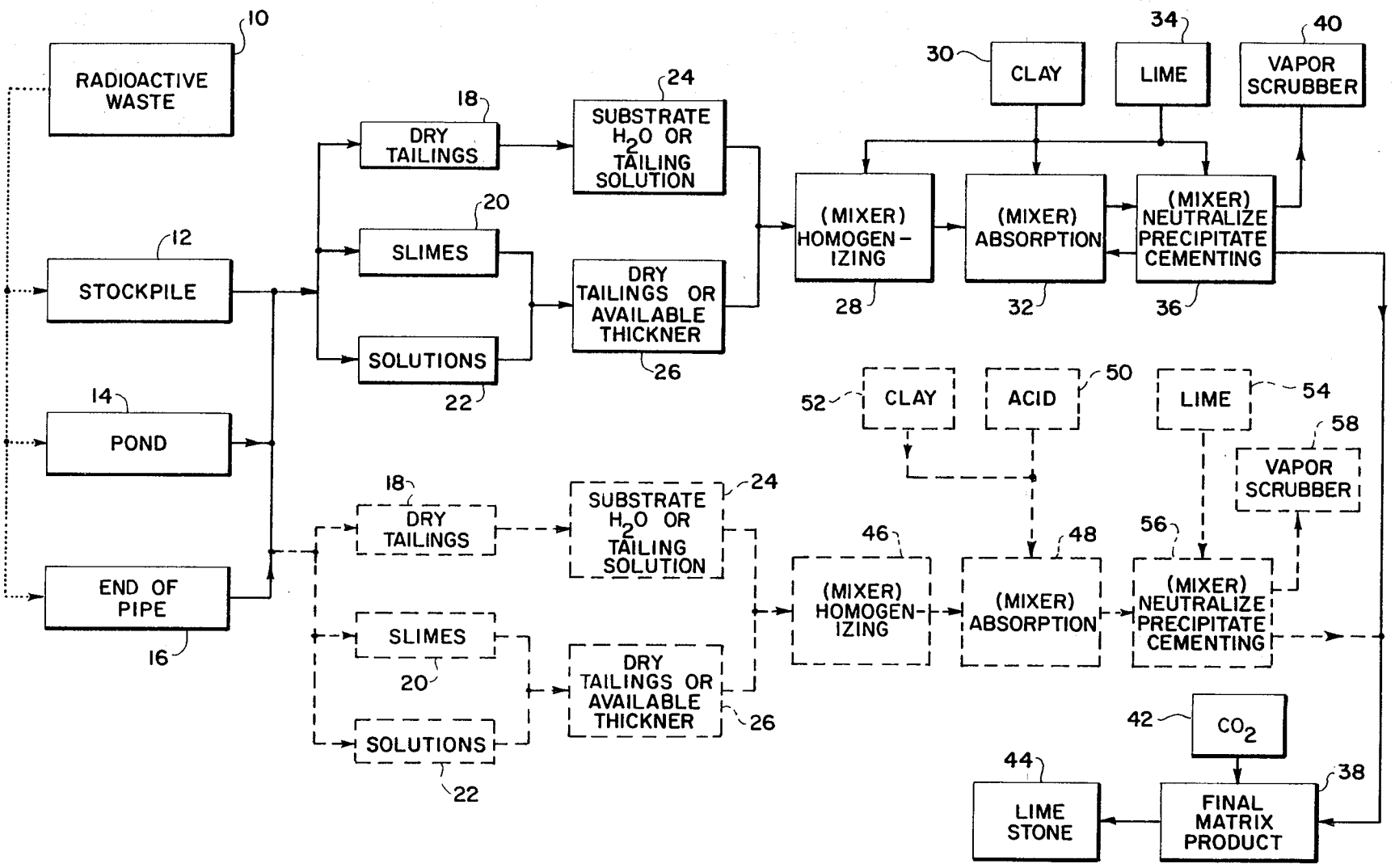
RADIOACTIVE WASTE
10
STOCKPILE
12
POND
14
END OF PIPE
16
DRY TAILINGS
18
SLIMES
20
SOLUTIONS
22
SUBSTRATE $H_2O$ OR TAILING SOLUTION
24
DRY TAILINGS OR AVAILABLE THICKNER
26
(MIXER) HOMOGEN-IZING
28
CLAY
30
(MIXER) ABSORPTION
32
LIME
34
(MIXER) NEUTRALIZE PRECIPITATE CEMENTING
36
VAPOR SCRUBBER
40
FINAL MATRIX PRODUCT
38
$CO_2$
42
LIME STONE
44
(MIXER) HOMOGEN-IZING
46
(MIXER) ABSORPTION
48
ACID
50
CLAY
52
LIME
54
VAPOR SCRUBBER
58
(MIXER) NEUTRALIZE PRECIPITATE CEMENTING
56
DRY TAILINGS
18
SLIMES
20
SOLUTIONS
22
SUBSTRATE $H_2O$ OR TAILING SOLUTION
24
DRY TAILINGS OR AVAILABLE THICKNER
26

PROCESSING RADIOACTIVE WASTES AND URANIUM MILL TAILINGS FOR SAFE ECOLOGICALLY-ACCEPTABLE DISPOSAL

This invention pertains to processing dry or aqueous radioactive wastes and uranium mill tailings and any accompanying toxic and hazardous waste materials into a substantially stabilized, insoluble, impermeable, encapsulated and solidified form suitable for safe and ecologically-acceptable disposal.

The present invention is a significant advancement and improvement in the field of the disposal of radioactive wastes and uranium mill tailings. Other inventions by the present inventor in the specifically non-related and generally collateral fields of oil sump and sewage disposal are described in U.S. Pat. No. 4,038,240, granted June 7, 1977; U.S. Pat. No. 4,079,003, granted Mar. 14, 1978; and U.S. Pat. No. 4,184,958, granted Jan. 22, 1980.

A considerable volume of uranium tailings have been and are being produced from mining and milling of uranium ores. The uranium mill tailings, which may be stockpiled or impounded in liquid-covered retention ponds, are of considerable concern from a safety and ecological standpoint. Radon gas RN-222, during the mining and milling process, will continually be produced and emanated from the mill tailings unless radium-226 and thorium-230 is removed from the uranium ore. Because of the long half lives of the radioactive elements, radon gas will be produced for a considerable period of time. For this reason, it is preferred that the uranium tailings typically be submerged in liquid in retention ponds. The liquid cover on the pond inhibits or prevents the emission of radon gas. Direct exposure to radon gas poses an immediate health threat, generally in the form of cancer.

Tailings retention ponds are a source of potential ground water contamination, and are exposed to contact by humans and wildlife. The liquid in the pond is either highly acidic or highly basic, depending upon the type of recovery process used in milling the uranium ore. In addition, the tailings liquid includes amounts of aluminum, ammonia, arsenic, calcium, carbonate, cadmium, chloride, copper, fluoride, iron, lead, manganese, mercury, molybdenum, selenium, sodium, sulfate, vanadium, zinc, natural uranium, radium-226, thorium-230, polonium-210 and bismuth-210, and total dissolved solids, including uranium ore ($U_3O_8$). Many of the materials accompanying the radioactive elements are hazardous and ecologically undesirable. These hazardous materials may leach from the retention pond into the ground water supply and are a health risk to humans and wildlife.

The principal objectives for disposing of uranium tailings have been to attempt to protect the ground water against contamination, to control the atmospheric emission of radon gas, and to isolate the tailings from man's environment, permanently, or for long time periods. However, there is no universally followed or successful practice for disposing of the uranium tailings. Indeed, population centers have grown up around or on top of exposed stockpiles of tailings, and the ground water has exhibited some radioactive contamination in some locations. Past practices for disposing of uranium tailings have included burying the tailings in deep trenches or in abandoned mine shafts. The ecological impact of such practices is uncertain. Attempts have been made to neutralize the acidic liquid being discharged into the tailings retention ponds to a pH which is not substantially acidic or basic by adding milk of lime and other forms of alkaline reagents. This type of neutralization could not be maintained, partially because of feed-mix variables and the intrusion of fresh water into the ponds from natural sources. Barium chloride processes have also been considered, but such processes are not effective in removing radium. An ion exchange process employing an organic resin specially compounded to collect ions from a solution of the uranium tailings has also been considered, but the success of this process depended on the freedom of the solution from excessive solids, which was impractical and uneconomical to achieve. Other partial techniques involve removing water from the tailings by solar evaporation, thermal evaporation or filtration. This procedure only addresses the liquid fraction of the overall disposal problem and does not address the disposal problem associated with the remaining solid materials.

Attempts have been made to encapsulate large quantities of uranium tailings to prevent leaching of the wastes into the ground water and to resist the diffusion and emission of radon gasses into the atmosphere. Prior encapsulation techniques involved constructing a clay or synthetic liner or clay covering of large quantity of tailings. Asphalt, asphalt and neoprene emulsions, resinous adhesives, elastomeric polymers, mixtures of wax and tar and pitch, and other chemical compounds have been tried as coatings or liners. These materials have, however, proved ineffective because of cracking and deterioration caused by the highly acidic or basic nature of the tailings, the weather and natural expansion and contraction. Cracked, deteriorated covering and expanded liners have allowed the diffusion of radon gasses into the atmosphere and the intrusion of natural water and seepage of tailings solutions into the ground water. Excessive costs were required to maintain or replace the liners or coverings.

None of the prior techniques for disposing of radioactive wastes and uranium tailings have succeeded in controlling and terminating the persistent emission of radon gas into the atmosphere, and in protecting the ground water from potential contamination.

SUMMARY

The present invention possesses the capabilities, among others, of substantially or totally encapsulating the radioactive wastes and accompanying chemical contaminants present in uranium mill tailings in a solid mass of rock-like material which is substantially impermeable to the emission of radon gas therefrom and which is substantially insoluble to the leaching or seepage of the radiological and hazardous organic chemical wastes into the ground water. The characteristics of the manufactured rock-like material allow it to be disposed of relatively safely and without substantial known ecologically damaging effects. The manufactured rock-like material need not be covered with liners, sealers, or the like, since the product inherently possesses the required characteristics for substantially isolating the radioactive wastes from the environment. As a further result of the practice of the present invention, it is possible to eliminate tailings retention ponds and stockpiles of tailings and return the land to safe ecological utilization.

According to its broad aspects, the process of the present invention comprises absorbing soluble radioactive wastes in an absorbing agent, preferably clay, and thereafter cementing the absorbed wastes and absorbing agent into a final matrix product having a pH of at least 8.0 and which is substantially impermeable. Cementing is achieved by use of lime, and the lime also renders the soluble radioactive wastes insoluble by pH neutralization or adjustment. Any non-neutralized contaminants are nonetheless captively held in the final matrix product. The final matrix product changes to a limestone in which the wastes are encapsulated by contact with carbon dioxide. The final matrix product achieves a significant reduction in the emission of radioactive gasses and the leaching out of soluble contaminants, and the resistance to both leaching and emission are improved in the limestone. The final matrix product is in a state for acceptable disposal.

A more complete and thorough understanding of the invention can be obtained by reference to the detailed description of its preferred embodiment and the accompanying drawing.

DRAWING

The single FIGURE of the drawing is a flow diagram illustrating the process states of the present invention, with the process states for acid-leach treatment shown by solid flow lines and certain process states for alkaline-leach treatment shown by dashed lines.

PREFERRED EMBODIMENT

Radioactive mill tailings resulting from the operation of acid-leach and alkaline-leach uranium milling and mining operations, which contain related inorganic process chemicals, comprise substantial sources of radioactive environmental contamination. Other sources are also appreciated, such as from nuclear power plants. With reference to the single drawing FIGURE, a source of radioactive waste material 10 is illustrated. Consistent with past practice, the radioactive wastes and associated chemical contaminants from uranium milling and mining operations are found in stockpiles 12, tailings retention ponds 14, and are present at the end of the discharge pipe 16 from the uranium mill. Of course, if the source of radioactive waste 10 is other than a uranium milling and mining operation, the radioactive waste 10 will typically be discharged at the end of the pipe 16. The discharged constituents from the uranium milling and mining operations typically include the radioactive wastes and chemical metal contaminants previously mentioned.

Dry tailings 18, slimes 20 and solutions 22 are typically present in the stockpiles 12 and ponds 14 and at the end of the pipe 16. Dry tailings are sandy materials consisting of particles greater than 200 mesh (greater than 75 microns). Slimes 20 consist of solids less than 200 mesh (less than 75 microns) and liquids which are solutions of chemicals from the ore and process reagents involved in mining, milling and transporting the tailings. The solutions 22 are solutions of process chemicals, reagents and transport liquids. Typically, thirty-five percent of the tailings, by weight, are slimes 20, and the slimes 20 contain approximately eighty-five percent of the radioactive materials present in the tailings. The effluent from an acid-leach milling and mining process has a typical pH of 1.5 to 2.0. The effluent from an alkaline-leach milling and mining process has a typical pH of 10.0 or more.

Acid-Leach Treatment

Initially, a mixture of solids and liquids of acid-leach radioactive wastes and associated contaminants is created. Dry tailings 18 should be blended with a substrate 24 to obtain a fluid or flowable mixture. The substrate 24 may be available water ($H_2O$) or tailings solution 22. A thickener 26 can be added to slimes 20 or solutions 22 to obtain a less fluid mixture of solids and liquids. The thickener may be dry tailings 18, soils, or clay. Although the dry tailings must be mixed with the substrate to obtain the flowable mixture of solids and liquids, the thickening of the solutions and slimes is basically a matter of process efficiency since increased amounts of solid wastes can be effectively treated simultaneously. The predetermined mixture of tailings solids and liquids is homogenized at 28 by use of a mixer to create a uniform slurry. The consistency of the final homogenized slurry should be at least flowable, but not pasty or friable.

An absorbing agent, such as clay 30, is added to and thoroughly mixed with the uniform slurry, as shown at 32. The clay 30, or other absorption agent, absorbs the radioactive wastes and chemical contaminants in a manner which is described below in greater detail. Lime 34 is next added and mixed at 36. As is also described in greater detail below, the lime adjusts or neutralizes the resulting mixture by raising the previous acidic pH to a basic pH to neutralize the acidic nature of the mixture. The lime also precipitates various soluble radiological and chemical contaminants as insoluble oxides and hydroxides, and cements the clay and absorbed contaminants in a matrix-like final product 38. Additionally, if the lime 34 is quicklime, an exothermic reaction or hydration occurs at 36. Any resulting water vapor or emissions is preferably passed through a vapor scrubber 40 to remove contaminants therefrom, prior to release of the vapor into the atmosphere.

The final matrix product 38 will typically have a semi-solid pasty to friable consistency in which the radionuclides and related chemical contaminants have been absorbed, neutralized and converted into insoluble oxides and hydroxides. The insoluble oxides and hydroxides will not substantially leach out of the final matrix product into the ground water system. The emanation of radon gas is prevented or substantially reduced by specifically neutralizing both radium-226 and thorium-230, to a pH of 8.0 to 9.0. The pH of the final matrix product should typically be no less than 8.0 to assure its substantial insolubility and impermeability.

The final discharge matrix product 38 uptakes carbon dioxide 42 from the air or other suitable source, and the matrix product 38 is thereby converted by the lime-cycle recarbonization process into a limestone 44 or calcium carbonate in which the absorbed and treated contaminants are held.

The final matrix product 38 can be safely disposed of in a variety of environmentally acceptable methods. The product 38 can be returned back to mined-out ore pits, or to holding impoundments.

In certain circumstances, the process steps referenced at 28, 32 and 36 may be accomplished in a single mixing apparatus, and possibly even simultaneously. In such circumstances, clay 30 can be utilized as a thickener 26, thereby achieving both thickening and absorption simultaneously with homogenizing of the mixture. In such a circumstance, it is, however, preferable that the lime 34 be added after the clay 30 has been incorporated into the thoroughly homogenized mixture of solids and liquids. In some other situations, it is possible to simultaneously add the clay 30 and the lime 34 to the homogenized slurry of solids and liquids derived at 28. It should also be noted that the clay 30, or other absorbing agent, will function on waste materials only in solutions. In such circumstances, the homogenized mixture of liquids and solids will simultaneously occur as absorption occurs at 32, from the addition of the clay 30 or other solid absorbing agent.

Certain types of clays 30 also have the inherent pH and capability for neutralizing, at least somewhat, the acidic slurry. In this regard, the clay 30 may replace quantities of the lime 34 required.

Alkaline-Leach Treatment

Practice of the present invention on alkaline-leach dry tailings 18, slimes 20 and solutions 22 is initially similar to that described for the acid-leach treatment, including the addition of a similar substrate 24 to the dry tailings 18 or the addition of a similar thickener 26 to slimes 20 and solutions 22.

A predetermined mixture of solids and liquids is thoroughly homogenized at 46. This mixture is, of course, very basic. Preferably, the solids and liquids of homogenized slurry produced at 46 is of the same consistency previously described.

It is believed desirable to adjust the pH of the slurry produced at 46 into the acid range at approximately the pH of 2.0 by adding and mixing at 48 an acid 50. The acid 50 may be a conventional acidic compound, typically sulfuric acid. In some circumstances, the inherent alkalinity of the slurry produced at 46 may itself create a sufficient insolubility effect.

A clay 52, or other absorbing agent, is thereafter added and mixed at 48 until the clay absorbs the radionuclide and chemical contaminants. After the radionuclide and chemical contaminants are absorbed into the clay, lime 54 is added and mixed at 56. The exothermic or hydrating reaction, neutralization and precipitation (if acid 50 was added), and cementing effects result, which are similar to those previously described at 36. The same type of final matrix product 38 is created. Similarly, any water vapor and emissions evolved are transmitted through a vapor scrubber 58 prior to release into the atmosphere.

In processing the alkaline-leach radioactive materials when acid is added, it is very important that the acid 50 be added to the slurry prior to the addition of substantial lime 54.

The required amount of lime 54 to be added may vary in accordance with the lime content or tailored characteristics of the selected clay 52. Of course, the final matrix product 38 reverts to limestone 44 by the reaction of carbon dioxide 42 with the calcium present in the product 38, as previously described. Disposal of the limestone 44 may proceed as has been described.

End of Pipe Process

The acid-leach treatment previously described will be practiced on effluent from the end of the pipe 16 which is of an acidic nature. The alkaline-leach process described above will be practiced on the effluent from the end of the pipe 16 which is of an alkaline nature.

Treatment at the end of the pipe 16 eliminates the need for future retention ponds 14 by providing a process for the direct treatment of tailings and slimes and solutions at the end of the pipe 16.

Absorption Agent

The important characteristics of the absorption agent, preferably clay, are the ability to absorb the contaminants on a relatively uniform basis throughout the porous particles of the absorbing material, and an ability to react with the calcium of the lime to lock the clay particles with the absorbed contaminants into calcium carbonate structure. Crystalline types of clay have the characteristic of an extreme fineness of individual clay particles, thereby achieving a highly effective and uniform absorption of the contaminants. Crystalline clays also have a diverse structural shape of a platy or tabular configuration which presents a relatively open crystal lattice of absorption pores into which the radioactive wastes and contaminants are physically trapped or absorbed and thereafter permanently bound as a result of the lime addition and mixture. Furthermore, the relatively open lattice structure of absorption pores allows the calcium of the lime to bind and cement the silicates of the clay while sealing in the bound contaminants in the limestone. A variety of other clays have limited absorption capacities, however the crystalline clays are more effective, having absorption and cementing characteristics required in the present invention. The absorption of certain materials by clay has been observed. The mechanism by which clay absorbs material is somewhat of a phenomenon which is not totally understood. A variety of empirical and theoretical descriptions of the various absorption phenomena of clay have been proposed, however such theories do not appear to adequately describe or teach the mass clay uptake of radionuclides from the varying dilute slurries.

It has been observed that the concentration of clay (the ratio of the mass of clay to the volume of the solids and liquids) can be changed in selected increments and the amount of radioactive waste uptake by a particular or selected clay can be determined. An increase in the selected clay concentration normally results in an increase in uptake. Similarly, the ability to uptake radionuclides in other contaminants by selected different types of clay can be observed and measured. On this basis, determinations on the amount of clay to be added to the slurry of solids and liquids to achieve the best uptake of radionuclides and contaminants can be derived.

Types of crystalline clays considered applicable for best practice in the present invention are as follows:

A. Two-layer type (sheet structures composed of units of one layer silica tetrahedrons and one layer of alumina octahedrons);
   1. Equidimentional kaolinite group, kaolinite, nacrite.
   2. Elongate, Halloysite group.
B. Three-layer types (sheet structures composed of two layers of silica tetrahedrons and one central dioctahedral or trioctahedral layer.
   1. Expanding lattice.
      a. Equidimensional montmorillonite group, montmorillonite, sauconite vermiculite.
      b. Elongate montmorillonite group, nontronite, saponite, hectorite.
   2. Nonexpanding lattice Illite group.
      c. Regular mixed-layer types (ordered stacking of alternate layers of different types) chloride group.
C. Chain-structure types (hornblende-like chains of silica tetrahedrons linked together by octahedral groups of oxygens and hydroxyls containing Al and Mg atoms)

1. Attapulgite
2. Sepiolite
3. Palygorskite

D. Phyllosilicates group for which a classification scheme is not shown herein, however, are classified in the absorbent groups.

E. Some clays by their generic reference, fitting into some of the above refered classification schemes.

Generic reference clays all have the common characteristic of containing aluminum silicate minerals. Examples are Bentonite, Attapulgite, Palex types, Bauxites, and improved activity clays. Bentonite clay is preferred in most situations because of its outstanding ability to carry particles of solid matter, such as the wastes and contaminants, in aqueous suspension. Bentonite also has a high bonding power when mixed with sand and other similar materials and its sealing characteristics in the presence of lime prevent the flow of liquid therein. Improved activity clays can be manufactured, usually from a montmorillinite aluminum silicate clay. The improved activity clays can be tailored with certain chemical and physical characteristics, due to the manufacturing process, which makes such clays uniquely valuable in the practice of the present invention.

Two characteristics availabe from certain types of clays which are uniquely of interest with respect to the present invention are, an ability to contribute toward the neutralization of acid or basic solutions, both of which are present in uranium milling and mining operations; and a limited ability to achieve a cementing action as a result of the calcium or manganese present in the clay itself. In most situations, however, the extent of neutralization and cementing available from the clay itself, without the addition of either acid or alkalines or lime, will be insufficient to achieve the desired results available from the present invention.

In practice of the present invention, sufficient clay should be added to obtain an equilibrium condition which, with reference to clay characteristics, achieves the most effective uptake or absorption of radioactive wastes and contaminants. Any soluble ions not precipitated by the action of neutralization will nonetheless be substantially absorbed by the clay, and as a result will be captively held in the final matrix product.

Lime

As used herein and with specific reference to the best applicability of the present invention, the term lime is intended to embrace quicklime and hydrated lime. Quicklime consists primarily of the oxides of calcium and magnesium. Quicklime can be divided into three classes: a high calcium quicklime containing less than five percent magnesium oxide; magnesium quicklime containing between five and thirty-five percent magnesium oxide; and dolmitic quicklime containing thirty-five to forty percent magnesium oxide. Preferably, any type of quicklime of at least ninety percent calcium oxide is preferred for use in the present invention, primarily because of its capability for an exothermic and hydrating reaction to remove water from the final matrix product. Hydrated lime is a dry powder obtained by treating quicklime with sufficient water to satisfy its chemical affinity for water. Under normal circumstances, the use of hydrated lime will create sufficient hydration reactions to remove water at a slower rate.

The limes react with the clay materials which have been mixed or blended with the slurry of solids and liquids in a manner which is believed to be primarily one involving the immediate exchange of ions between the calcium, sodium and hydrogen on the surface of the clay particles. The larger calcium ions ($Ca++$) from the calcium limes replace the larger hydrogen ($H+$) and sodium ($Na+$) ions on the clay particles. Cation sodium ($Na+$) is undesirable in clay materials because it can contain or attract seventy-nine molecules of water. It is highly desirable to replace the cation sodium with the calcium ion which can retain or attract only two molecules of water. Calcium compounds, therefore, change clay from a hydrophilic to a hydrophobic condition, allowing the release of bound water to evaporation. This partly accounts for a fast drying action when calcium oxide or other calcium compounds are applied to wet clays. The formation of complex silicates occurs within the clay lattice and is responsible for the marked reduction in permeability and the increase in strength due to cementation of the clay mass. The exothermic and hydrating reactions present when quicklime is mixed with the mixture of solids and liquids removes a substantial amount of the water and converts the calcium oxide into calcium hydroxide.

Effects

It has been determined that practice of the present invention and achieving a pH of at least 8.0 in the final matrix product causes the precipitation of at least ninety percent of the radium, almost all of the thorium, iron, copper, cobalt, arsenic, uranium, vanadium, and other heavy metal ions, as insoluble oxides and hydroxides, from the mixture of solids and liquids. Lime neutralization of the sulfate bearing wastes is more effective in removing radium, presumably because the calcium sulfate ($CaSO_4$) which precipitates serves as a carrier for the radium. Upon the addition of lime, sulfate, phosphate and similar anions, are precipitated as insoluble calcium salts.

The effect of absorption and neutralization is quite notable. The seepage or runoff from the final matrix product carries very little radium in contrast to the seepage or runoff from natural tailings effluent which do carry dissolved radium. The seepage from the final resulting limestone is essentially nondetectable. The following Tables III and V reflect these important characteristics.

Although not thoroughly understood at this time, it is believed that the precipitation, absorption and cementing of the radium-226 parent and thorium-230 grandparent substantially inhibits or prevents radioactive decay in such a manner as to prevent the production and emanation of radon-222 gas. The daughters of radon-222 (polonium-210, polonium-218, lead-214, lead-210 and bismuth-214) deposit on dust particles in the air or themselves are airborne particulates and cause a significant part of the total airborne radioactive particulate. It is also known that radon naturally migrates through a porous media by a transport phenomenon. Because of the lime neutralization, the clay absorption and the cemented final matrix product, the decay and radon gas release can be effectively prevented, as described above.

Large monolithic masses of limestone, if they are created as described above from practicing the present invention, offer a unique advantage of being able to reknit cracks in the mass created during earthquakes or differential settlement of the earth formation. Although it is unlikely that any contaminants may escape from the cracks, because they have been absorbed and neutralized as set forth above, recarbonization of the lime at the cracks will occur. This is referred to as autogenous healing, and the process prevents the intrusion of fresh water into the cracks, thereby further reducing the risk of release of material. No other known prior art encapsulating, covering or lining materials have the capability for autogenous healing.

The following examples are illustrations of the practice of the present invention.

Examples

A sample of uranium mill tailings, slimes, solutions and dry beached tailings was obtained from a uranium mill employing an acid-leach mining process. Equal parts by weight, of slimes, solutions and dry tailings were prepared. This mixture of combined tailings wastes averaged ninety to ninety-five pounds per cubic foot. A mixer having a process capacity of one cubic foot was employed. The tailings wastes were homogenized in the mixer for less than one minute until the slimes, tailings and solutions were converted into a uniform slurry. Bentonite clay was added to the uniform slurry until the material was converted to a pasty consistency. Clay was added in the average weight ratio of 0.10 unit weight of clay to 1.0 unit weight of uniform slurry. In processing the acid-leach tailings waste, calcium oxide was added to the combined clay and wastes at an average of approximately six percent by weight of the combined clays and tailings waste. The pH was raised from approximately 2.0 to approximately 10.0. In processing the alkaline-leach wastes, which typically had a pH of 10.0, the pH was lowered after the addition of the clay to approximately 3.4 using a technical grade of sulfuric acid. Thorough mixing thereafter commenced. Within several minutes after reducing the pH to 3.4, calcium oxide was added to raise the pH to approximately 10.0. Similarly, calcium oxide was added to the acid-leach materials after the clay was mixed with the tailings waste. In both cases, calcium oxide was added in a quantity of about six percent, by weight, of the combined clay and waste. The total elapsed time for the process was approximately four to five minutes average. The discharged final matrix product was of a heavy pasty consistency. Within the average period of about thirty minutes after the final matrix product was discharged, it had transformed into a friable hardened material and continued cementing was apparent.

Laboratory tests to determine the radon gas migration rate as compared to untreated wastes, indicated an average reduction of radon gas emission of approximately ninety-three percent. Testing of the treated material began approximately ten days after the conclusion of the process. Neither the acid-leach nor alkaline-leach waste materials indicated any substantial difference in the reduction of emanation. The laboratory tests before and after processing on both the acid-leach and alkaline-leach waste are set forth in Tables I, II, III, IV and V below.

TABLE I

SOLIDIFICATION OF URANIUM TAILINGS-RADON-222 REDUCTION

ALPHA SCINTILLATION TECHNIQUE

| Sample # | Time for Equilibrium | SOLIDIFIED counting rate (cpm) | SLURRY counting rate (cpm) | % Reduction of Radon-222 |
|---|---|---|---|---|
| A-1 | 12 hours | $5.50 \times 10^2$ | $6.87 \times 10^3$ | 92.00 |
| A-2 | 3 days | $2.50 \times 10^2$ | $3.98 \times 10^3$ | 93.72 |
| A-3 | 7 days | $6.00 \times 10^2$ | $8.50 \times 10^3$ | 92.94 |
| A-4 | 2 weeks | $3.90 \times 10^2$ | $7.80 \times 10^3$ | 95.00 |
| B-1 | 12 hours | $4.00 \times 10^2$ | $5.40 \times 10^3$ | 91.48 |
| B-2 | 3 days | $4.00 \times 10^2$ | $8.10 \times 10^3$ | 95.06 |
| B-3 | 7 days | $4.50 \times 10^2$ | $6.89 \times 10^3$ | 93.47 |
| B-4 | 2 weeks | $2.80 \times 10^2$ | $4.98 \times 10^3$ | 94.38 |
| | | | Mean | 93.51 |

GAMMA SPECTRAL TECHNIQUE
(Intrinsic (HPGE) Detector 23% Eff)

| Sample # | Isotope | SOLIDIFIED | SLURRY | % Reduction |
|---|---|---|---|---|
| A-1 | Pb-214[a] | $5.44 \times 10^2$ pCl/gm | $2.36 \times 10^3$ pCi/gm | 76% |
| A-1 | Bi-214[a] | $7.58 \times 10^2$ pCi/gm | $2.22 \times 10^3$ pCi/gm | 66% |
| A-1 | Bi-214[b] | $9.68 \times 10^3$ pCl/Total | $9.80 \times 10^4$ pCl/Total | 90% |

[a]The solid sample was sealed in a metal can for 12 hours to reach secular equilibrium.
[b]After reaching secular equilibrium (12 hours), the gas was transferred to a counting cell.

TABLE II

SOLIDIFICATION URANIUM TAILINGS-URANIUM CONCENTRATION

| Sample # | SLURRY (μg/g) | SOLIDIFICATION (μg/g) |
|---|---|---|
| A-1 | 29.8 | 31.0 |
| A-2 | 29.8 | 30.4 |
| A-3 | 32.2 | 38.4 |
| A-4 | 31.9 | 38.1 |
| | $\bar{x} = 30.9$ | $\bar{x} = 34.5$ |

NOTE:
Based on the above results a 10.4% greater Uranium concentration was found in the solidified tailings.

TABLE III

| Analysis | SLURRY | LEACH STUDIES URANIUM TAILINGS SOLIDIFIED | SOLIDIFIED** EP-Toxicity | SOLIDIFIED Acid Rain* Leach |
|---|---|---|---|---|
| Radium-226 | $(1.97 \pm 0.002)10^3$ pCi/gm | $(5.57 \pm 0.005)10^2$ pCi/gm | <0.6 pCi/l | $2.39 \pm 0.25$ pCi/l |

*Simulation of Acid Rain when the atmosphere has significant concentration of sulfer dioxide. Samples were therefore leached in 0.5 N $H_2SO_4$.
**Normal leaching process with 0.5 N Acetic Acid (ASTM D19:12 Method).

TABLE IV

COMPARISON ALPHA SPECTROMETRIC COUNTS BETWEEN FREEZE DRIED AND TEMPERATURE ACCLIMATED URANIUM TAILINGS SAMPLES

| | SLURRY count rate (cpm) | SOLIDIFIED count rate (cpm) | Equilibrium Time | % Reduction |
|---|---|---|---|---|
| Freeze Dried (−2.2° C.) | $1.45 \times 10^3$ | $2.20 \times 10^2$ | 12 hours | 85.0 |
| Temperature Acclimated (40° C.) | $9.07 \times 10^3$ | $6.50 \times 10^2$ | 12 hours | 93.05 |

TABLE V

SOLIDIFIED URANIUM TALINGS

| Analysis | SOLIDIFIED Tailings μg/gm | EP-TOXICITY* mg/l | ACID RAIN** mg/l |
|---|---|---|---|
| Arsenic | 75 | 0.6 | 0.3 |
| Barium | 360 | <0.1 | <0.1 |
| Cadmium | <10 | <0.1 | <0.1 |
| Chromium | <10 | <0.1 | <0.1 |
| Iron | 14,900 | <0.1 | <0.1 |
| Lead | <10 | 0.2 | <0.1 |
| Molybdenum | <10 | <0.1 | <0.1 |
| Selenium | <10 | <0.1 | 0.1 |
| Silver | <10 | <0.1 | <0.1 |
| Vanadium | 520 | <0.1 | <0.1 |

*Simulation of Acid Rain when the atmosphere has significant concentration of sulfur dioxide. Samples were therefore leached in 0.5 N $H_2SO_4$.
**Normal leaching process with 0.5 N Acetic Acid (ASTM D19:12 Method).

Preferred embodiments of the present invention have been shown and described with a degree of particularity. It should be understood, however, that such description has been made by way of preferred example and that certain changes may be made without departing from the scope of the invention defined by the appended claims.

What is claimed is:

1. The method of treating acid leach uranium, radiological and toxic metal radon emitting waste selected from the class that consists of mill tailings, slimes and aqueous solutions to a dimensionally stable, substantially insoluble matrix that has a substantially lowered rate of randon emission, said method comprising the steps of:

a. transforming said waste into a homogeneous aqueous slurry;
b. agitating said slurry and sequentially adding a crystalline clay having an open lattice thereto, said clay including sodium and hydrogen ions to which a substantial number of molecules of water are bound, said lattice absorbing soluble salts of said metals in said waste;
c. adding said clay and continuing said agitation until said slurry is of pasty consistency;
d. directing said slurry of pasty consistency to a confined space;
e. mixing calcium oxide with said pasty slurry in said confined space in a sufficient quantity to:
   1. raise the pH of said slurry above 8;
   2. displace a substantial quantity of said sodium and hydrogen with calcium to liberate water from said clay;
   3. transform the soluble salts of metals in said waste that are in said lattice of said clay into insoluble oxides and hydroxides that are locked therein as said hydrogen and sodium is replaced by calcium;
   4. engender an exothermic reaction in said confined space that results in the slurry-calcium oxide mixture being transformed to said matrix with the concurrent emission of water in the form of steam from said slurry calcium oxide mixture into said confined space;
f. removing foreign material from said steam;
g. discharging said steam free of said foreign material from said confined space to the ambient atmosphere; and
h. removing said matrix from said confined space.

2. The method as defined in claim 1 which includes the further step of:

i. exposing said matrix to the air for carbon dioxide in the air to react with said matrix to form an envelope of limestone thereabout that serves as a barrier to lessen the rate of radon emission from said matrix.

3. The method as defined in claim 1 which includes the further step of:

i. exposing said matrix to carbon dioxide to transform at least a major portion thereof to limestone from which said oxides and hydroxides will not leach out when said matrix is exposed to water.

4. The method as defined in claim 1 in which said waste was an alkali leach that was transformed to an acid leach by the addition of an acid thereto prior to said method being performed thereon.

* * * * *